US010145130B1

(12) United States Patent
Yin et al.

(10) Patent No.: US 10,145,130 B1
(45) Date of Patent: Dec. 4, 2018

(54) SEALING STRUCTURE FOR THE BOTTOM OF A BEAM SPACE BETWEEN PRECAST PANELS

(71) Applicant: RUENTEX ENGINEERING & CONSTRUCTION CO., LTD., Taipei (TW)

(72) Inventors: Samuel Yin, Taipei (TW); Tzu-Liang Wu, Taipei (TW)

(73) Assignee: RUENTEX ENGINEERING & CONSTRUCTION CO., LTD., Taipei (TW)

( * ) Notice: Subject to any disclaimer, the term of this patent is extended or adjusted under 35 U.S.C. 154(b) by 0 days.

(21) Appl. No.: 15/798,737

(22) Filed: Oct. 31, 2017

(30) Foreign Application Priority Data

Sep. 8, 2017 (TW) ..... 106213324 U

(51) Int. Cl.

| | |
|---|---|
| ***E04G 13/00*** | (2006.01) |
| ***E04B 1/20*** | (2006.01) |
| ***E04B 5/04*** | (2006.01) |
| ***E04G 9/04*** | (2006.01) |
| ***E04G 17/02*** | (2006.01) |
| ***E04G 9/10*** | (2006.01) |
| *E04B 5/02* | (2006.01) |
| *E04C 2/04* | (2006.01) |

(52) U.S. Cl.

CPC ..... *E04G 13/00* (2013.01); *E04B 1/20* (2013.01); *E04B 5/04* (2013.01); *E04G 9/04* (2013.01); *E04G 9/10* (2013.01); *E04G 17/02* (2013.01); *E04B 2103/02* (2013.01); *E04C 2/044* (2013.01); *E04C 2/50* (2013.01)

(58) Field of Classification Search

CPC . E04G 17/00; E04G 13/00; E04B 5/17; E04B 1/20; E04B 5/04

See application file for complete search history.

(56) References Cited

U.S. PATENT DOCUMENTS

| | | | | |
|---|---|---|---|---|
| 3,712,188 | A * | 1/1973 | Worson | E01C 11/10 404/48 |
| 4,699,540 | A * | 10/1987 | Gibbon | E01D 19/06 404/49 |
| 6,183,575 | B1 * | 2/2001 | Embelton | E01C 7/147 156/71 |
| 2003/0223814 | A1 * | 12/2003 | Peltz | E01C 11/103 404/75 |

FOREIGN PATENT DOCUMENTS

| | | |
|---|---|---|
| CN | 2683763 Y | 3/2005 |
| CN | 2687227 Y | 3/2005 |

* cited by examiner

*Primary Examiner* — Beth A Stephan

(74) *Attorney, Agent, or Firm* — Juan Carlos A. Marquez; Marquez IP Law Office, PLLC

(57) ABSTRACT

A sealing structure for the bottom of a beam space between precast panels, comprising: a first precast panel and a second precast panel substantially aligned to each other along a single plane and spaced from each other by a space, each of the first precast panel and the second precast panel defining an inner edge adjacent to the space; a soft pad abutting the space for sealing a bottom of the space; a plate abutting the soft pad; a fastening device securing a first side of the plate and a second side of the plate to the first precast panel and second precast panel, respectively, so as to assist the soft pad in the sealing of the bottom of the beam space; wherein the fastening device does not contact the soft pad.

12 Claims, 5 Drawing Sheets

SEALING STRUCTURE FOR THE BOTTOM OF A BEAM SPACE BETWEEN PRECAST PANELS

TECHNICAL FIELD

The subject invention discloses a sealing structure for the bottom of a beam space between precast panels.

BACKGROUND

Complex precast construction methods are used to build a high-tech plant, e.g., a semiconductor wafer fab. Most project tasks that previously had to be done on site can be completed in advance in a plant by employing precast construction methods. Main components, such as beams, columns, and slabs, can all be produced in the precast method. In particular, a complex precast construction method allows project tasks to be done by producing the precast components in the plant in advance, sending them to the construction site, and then using machines and hoist equipment to finish the remaining project tasks on the construction site, including component assembly, rebar connection and limited concrete casting. This minimizes on-site workload, and greatly reduces labor and time. Construction time is also effectively shortened. Meanwhile, safety is improved because traditional erection of external scaffolding can be avoided.

It is also advantageous that crevices are not easily produced in the wall surfaces of the precast panels of a plant as a result of seismic activity.

CN2683763Y is a typical prior art in this technical field. It discloses a beam position bottom closing device for precast floor slab, including two precast floor slabs spaced apart from each other by a gap for the beam position, a square formwork to close the bottom of the gap, a sealing body between the square formwork and the precast floor slabs, cross bars below the formwork, upper support bars provided with respect to the cross bars and on the gap between the precast floor slabs, connecting members (60), which extend through the cross bars, formwork, sealing body and upper support bars to allow each element from the upper support bars to the cross bars to abut against each adjacent element such that the formwork can be forced to urge against the sealing body and closely contact the precast floor slabs. Under the fastening of the connecting members, the upper support bars and the cross bars can allow the formwork and the sealing body to be tightly attached to the precast floor slabs.

This conventional art relies on the passing of the connecting members (60) through the gap for the beam position, all of the fastening elements and the sealing body (30) so as to obtain the effect of closing the bottom of the gap and securing the fastening elements. That is, the sealing body (30) which contacts the concrete slurry is inevitably formed with holes. Leakage may occur due to the holes. Further, there may be undesired problems due to the connecting members that extend through the concrete slurry. Under the circumstances, there is need for improvement of the conventional art.

DESCRIPTION

In one aspect, the present invention provides a sealing structure for sealing the bottom of a beam space between precast panels, comprising: a first precast panel and a second precast panel, a soft pad, a plate or plywood abutting the soft pad and a fastening device.

The first precast panel and the second precast panel are formed with a first group of thru apertures and a second group of thru apertures, respectively, and substantially aligned to each other along a single plane and spaced from each other by a space, each of the first precast panel and the second precast panel defining an inner edge adjacent to the space.

The soft pad abuts the space for sealing a bottom of the space, said soft pad extending from the inner edge of the first precast panel to the inner edge of the second precast panel.

The plate abuts the soft pad and extends from the inner edge of the first precast panel to the inner edge of the second precast panel.

The fastening device secures a first side of the plate and an opposite second side of the plate to the first precast panel and the second precast panel, respectively, so as to assist the soft pad in the sealing of the bottom of the beam space by clamping the soft pad between the plate and the first and the second precast panels, wherein the fastening device does not contact the soft pad.

According to a preferred embodiment of the present invention, a sealing structure for sealing the bottom of a beam space between precast panels comprises a first precast panel and a second precast panel, a soft pad, a plate abutting the soft pad, a fastening device, and ribs which can be fastened with the first precast panel and the second precast panel together by the fastening device.

The first precast panel and the second precast panel are formed with a first group of thru apertures and a second group of thru apertures, respectively, and substantially aligned to each other along a single plane and spaced from each other by a space, each of the first precast panel and the second precast panel defining an inner edge adjacent to the space.

The soft pad abuts the space for sealing a bottom of the space, said soft pad extending from the inner edge of the first precast panel to the inner edge of the second precast panel.

The plate abuts the soft pad and extends from the inner edge of the first precast panel to the inner edge of the second precast panel.

The fastening device secures a first side of the plate and an opposite second side of the plate to the first precast panel and the second precast panel, respectively, so as to assist the soft pad in the sealing of the bottom of the beam space by clamping the soft pad between the plate and the first and the second precast panels, wherein the fastening device does not contact the soft pad.

The ribs abut against the surfaces of the first precast panel and of the second precast panel, which are opposite to the soft pad, said ribs being fastened with the first precast panel and the second precast panel together by the fastening device, wherein said ribs comprise one rib which is entirely secured to the first precast panel and one rib which is entirely secured to the second precast panel.

The above and other advantageous features of the subject invention may better be understood by reference to the following description and the attached drawings.

DETAILED DESCRIPTION

Figure 1:
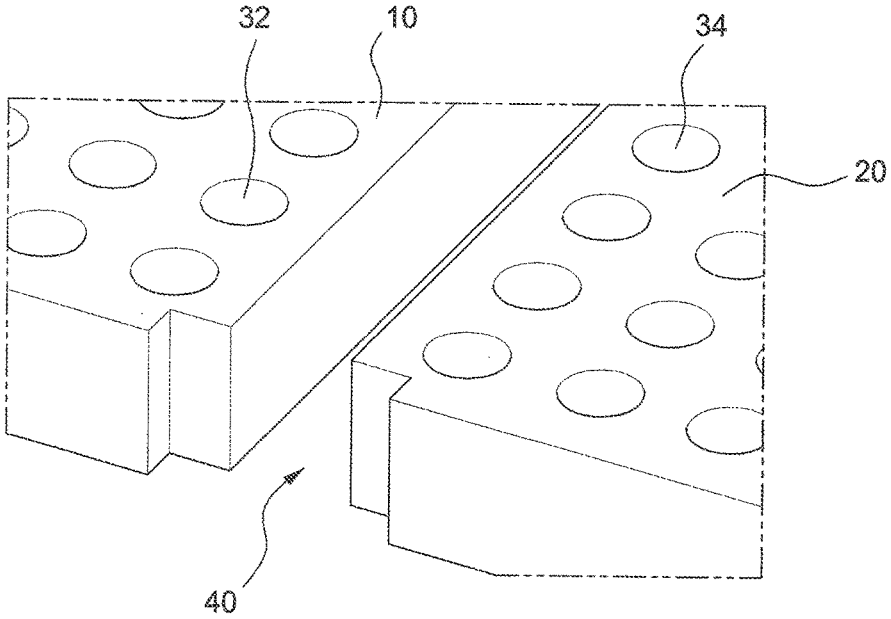
FIG. 1 is a schematic view showing the first precast panel and the second precast panel which are spaced from each other by a space.

Various aspects are described below with reference to the drawings. The relationship and functioning of the various elements may better be understood by reference to the following description. However, aspects are not limited to those illustrated in the drawings or explicitly described below. It also should be understood that the drawings are not necessarily to scale, and in certain instances, details may have been omitted that are unnecessary for an understanding of aspects disclosed herein.

With respect to FIG. 1, a schematic view showing the relationship of a first precast panel (10) and a second precast panel (20) according to the present invention is disclosed. The first precast panel (10) and the second precast panel (20) are formed with a first group of thru apertures (32) and a second group of thru apertures (34), respectively, and substantially aligned to each other along a single plane and spaced from each other by a space (40), which is used for the pouring of concrete to form a beam or the like. A cavity can be formed at a front thereof between the first precast panel (10) and the second precast panel (20) to form a column or the like. In FIG. 1, the thru apertures are distributed all over the surface of the first precast panel (10) and the second precast panel (20), such that each of these precast panels exhibits a cheese-shaped surface Alternatively, the thru apertures may be partially provided on the precast panels. These thru apertures can allow the precast panels to be lifted by the hoist equipment. In addition to the lifting purposes, these thru apertures may also assist in the assembly of the sealing structure according to the present invention.

Figure 2A:
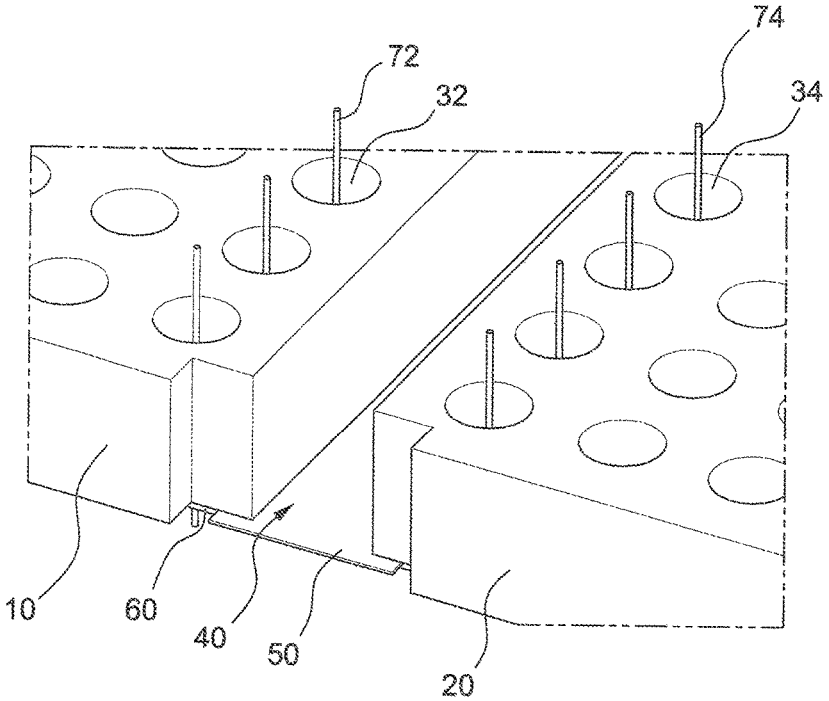
FIG. 2A is a partial, upper perspective view according to an embodiment of the present invention.
Figure 2B:
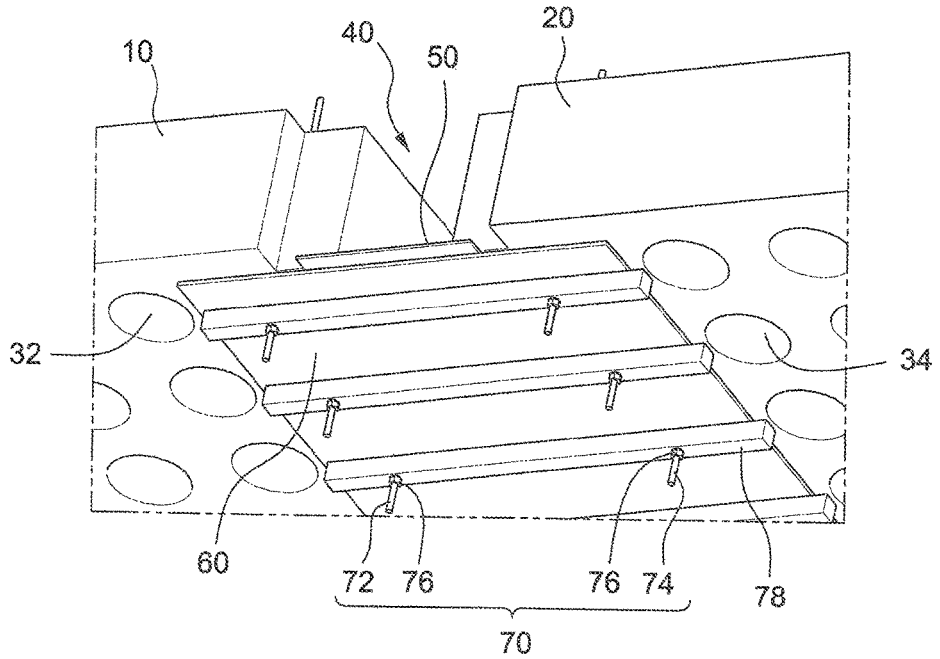
FIG. 2B is a partial, lower perspective view of FIG. 2A.

FIGS. 2A and 2B disclose the partial, upper and lower perspective views according to an embodiment of the present invention. Each of the first precast panel (10) and the second precast panel (20) defines an inner edge adjacent to the space, or more specifically, adjacent to a bottom of space (40). The top of space (40) remains open to allow the pouring of concrete to form a beam. A soft pad (50) abuts the space at the bottom of the space (40) for sealing said bottom. The soft pad (50) is preferably configured such that its length can straddle between the inner edges of the first precast panel (10) and the second precast panel (20), which means that the soft pad (50) extends from the inner edge of the first precast panel (10) to the inner edge of the second precast panel (20) to fully close the bottom of the space (40). The material of the soft pad (50) can be selected from rubber, soft plastics or silicon, etc. Soft pad (50) is used to prevent the leakage of the concrete slurry. The combination of the soft pad (50) and a clamping device or a fastening device can provide excellent sealing effect to prevent leakage of the concrete slurry. In particular, the soft pad (50) can provide excellent an leakage-proof effect because the nature of its soft material can overcome the deficiencies caused by the shape of the first and second precast panels (10, 20), including the uneven surfaces of and the slight differences in width between the first precast panel (20) and the second precast panel (20).

A plate or plywood (60) abuts the soft pad (50) and extends from the inner edge of the first precast panel (10) to the inner edge of the second precast panel (20). The main purposes of the plate (60) are leveling and clamping the soft pad (50) as shown in the figures. The material of plate (60) can be selected from a board or other material that can achieve the same purposes.

The fastening device (70) secure a first side of the plate (60) and an opposite second side of the plate (60) to the first precast panel (10) and the second precast panel (20), respectively, so as to assist the soft pad (50) in the sealing of the bottom of the beam space (40) by clamping the soft pad (50) between the plate (60) and the plane of the first and the second precast panels (10, 20), the fastening device (70) having an end(s) extending through at least some through apertures of the first group of through apertures (32) and the second group of thru apertures (34) and secured to a first (upper) surface of the first precast panel (10) and a second (upper) surface of the second precast panel (20), which are opposite to the soft pad (50), or more specifically, opposite to the (lower) surfaces of the first precast panel (10) and the second precast panel (20) contacting the soft pad (50). The fastening device (70) does not contact the soft pad (50); or more specifically, the fastening device (70) does not extend through the soft pad (50). Therefore, the fastening device (70) does not destroy the soft pad (50). Preferably, the fastening device (70) includes a first group of bolt locking devices preferably consisting of bolts (72) and nuts (76) which are threaded to each other and a second group of bolt locking devices preferably consisting of bolts (74) and nuts (76) which are threaded to each other.

The first group of bolt locking devices secures the first side of the plate (60) to the first precast panel (10) by extending through the first side of the plate (60) and through at least a number of thru apertures of the first group of thru apertures (32). Similarly, the second group of bolt locking devices secures the second side of the plate (60) to the second precast panel (20) by extending through the second side of the plate (60) and through at least a number of thru apertures of the second group of thru apertures (34).

If plate or plywood (60) does not provide sufficient strength, the weight of the concrete slurry in the space (40) may cause the plate or plywood (60) to deform, and thereby reduce the sealing effect of the soft pad (50). In particular, a plate (60) made of wood may easily be damaged by such weight. Preferably, a first group of ribs (78) is provided. The first group of ribs (78) abuts against the plate (60) and extends from a first side of the plate (60) toward the second side of the plate (60). Preferably, the fastening structure is configured such that each rib of the first group of ribs (78) allows each bolt locking device of the first group of bolt locking devices and each bolt locking device of the second group of bolt locking devices to extend through respective ends thereof. Then a first end of each rib and the first side of the plate (60) can be secured to the first precast panel (10), and a second end of each rib and the second side of the plate (60) can be secured to the second precast panel (20). With the above structure, the first group of ribs (78) can be fastened with the first precast panel (10) and the second precast panel (20) together by the first group of bolt locking devices and the second group of bolt locking devices. The structure can improve the load bearing capacity of plate (60), evenly distribute the load on the plate (60) and increase the service life of the soft pad (50) and plate (60). The ribs are preferably selected from timbers, square timbers or square tubes.

Figure 3:
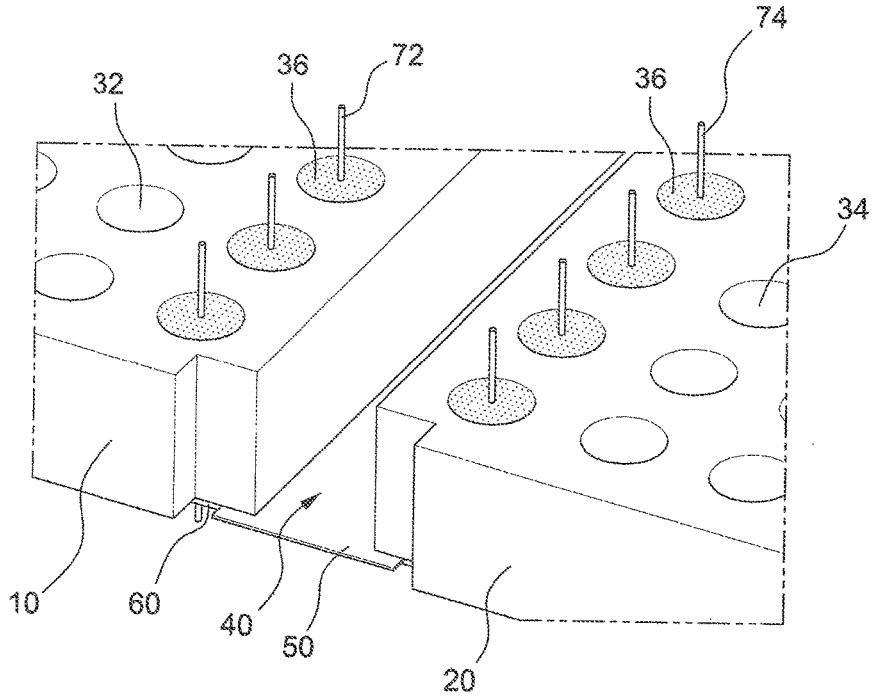
FIG. 3 is a schematic view showing a number of the thru apertures in FIG. 2A covered with lids.
Figure 4A:
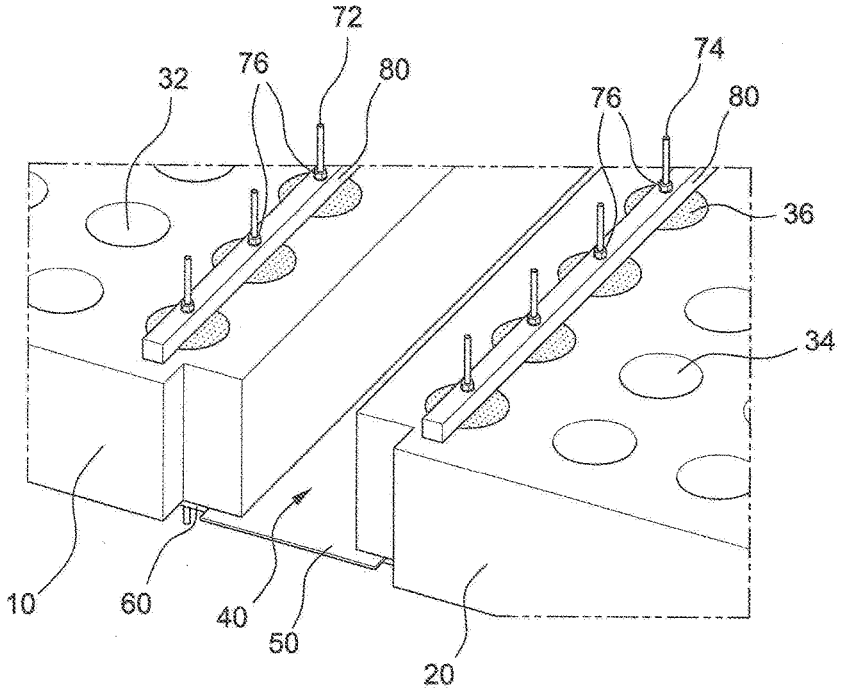
FIGS. 4A-4C and 5 are schematic views showing a second group of ribs arranged on the surfaces of the first and second precast panels.
Figure 4B:
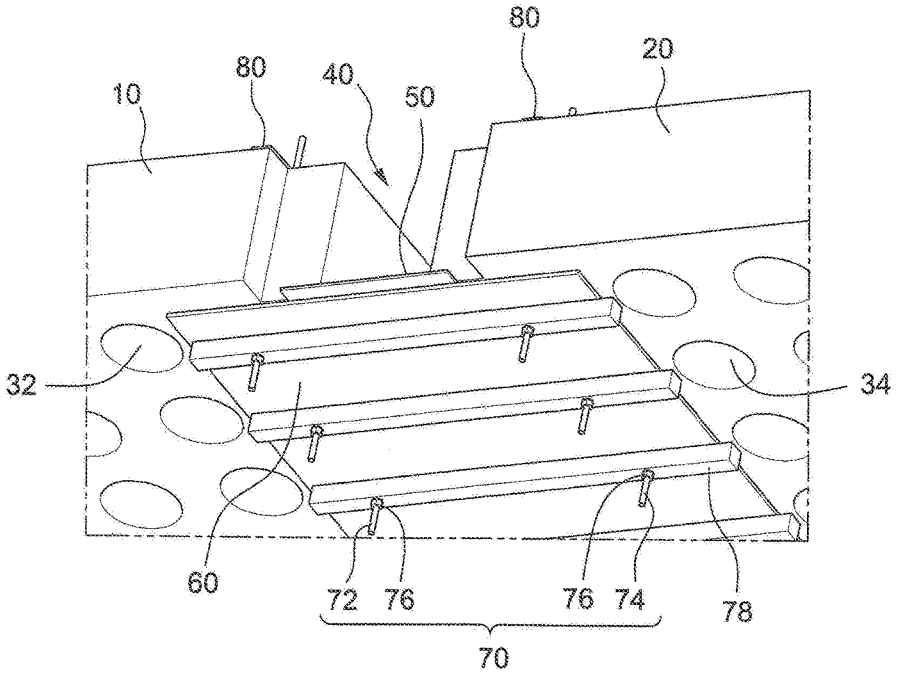
Figure 4C:
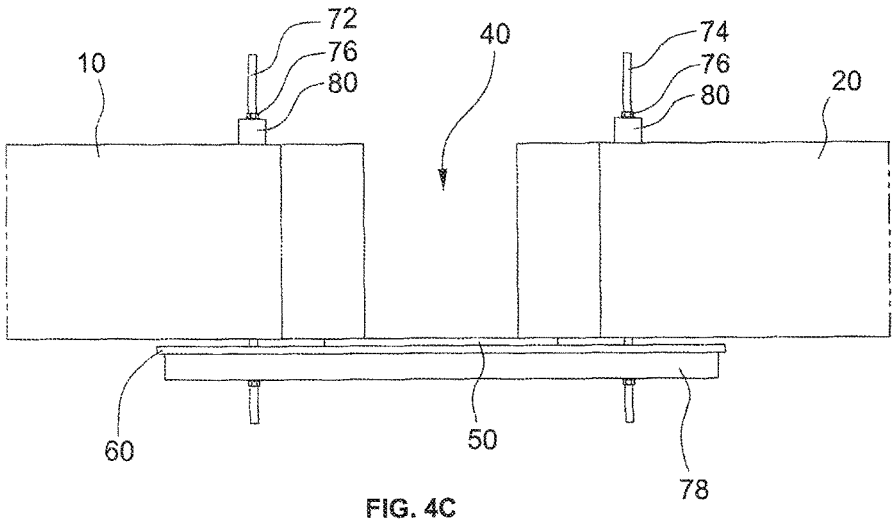
Figure 5:
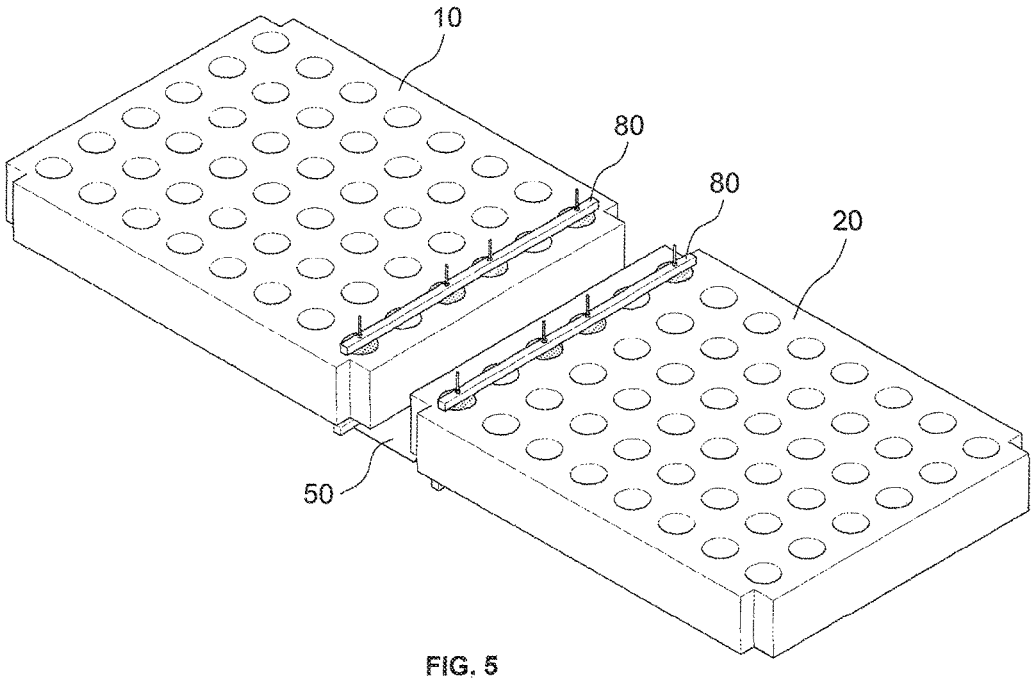

The size of each through aperture (32, 34) may be so large that a person can fall through it. As shown in FIG. 3, for safety's sake, at least a number of thru apertures of the first group of thru apertures (32) and the second group of thru apertures (34) may be covered with lids (36) to prevent construction workers from falling.

Further, as shown in FIGS. 4A, 4B, 4C and 5, a second group of ribs (80) can be provided. The second group of ribs (80) abuts against the first (upper) surface of the first precast panel (10) and the second (upper) surface of the second precast panel (20), which are opposite to the soft pad (50), or more specifically, opposite to the (lower) surfaces of the first precast panel (10) and the second precast panel (20) contacting the soft pad (50). The second group of ribs (80) is fastened with the first precast panel (10) and the second precast panel (20) together by the first group of bolt locking devices and the second group of bolt locking devices. Preferably, the second group of ribs (80) is fastened with the first precast panel (10) and the second precast panel (20) together by extending bolts (72, 74) through at least a number of thru apertures of the first group of thru apertures (32) and the second group of thru apertures (34) and the second group of ribs (80). According to an embodiment disclosed in FIGS. 4A-4C, the fastening structure is configured such that each bolt locking device of the first group of bolt locking devices and each bolt locking device of the second group of bolt locking devices respectively extend through one rib of the second group of ribs (80). With this structure, the second group of ribs (80) comprises one rib which is entirely secured to the first precast panel (10) and one rib which is entirely secured to the second precast panel (20).

Figure 6:
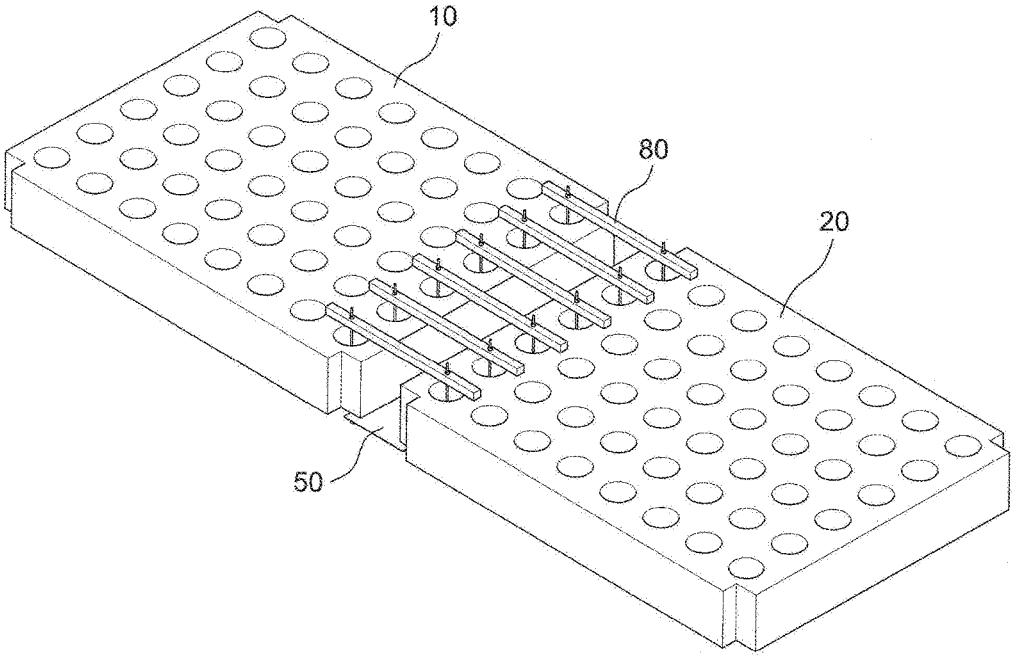
FIG. 6 is a schematic view showing a modified arrangement of the second group of ribs on the surfaces of the first and second precast panels.

FIG. 6 discloses another embodiment of the connection structure of the second group of ribs (80), wherein two ends of at least one rib of the second group of ribs (80) are respectively secured to the first precast panel (10) and the second precast panel (20). Specifically, the first group of bolt locking devices and the second group of bolt locking devices respectively extend through a first end and a second end of the at least one rib to allow the first end and the second end of the at least one rib to be secured to the first precast panel (10) and the second precast panel (20), respectively.

The disclosure encompasses any and all possible combinations of some or all of the various aspects described herein. It should also be understood that various changes and modifications to the aspects described herein will be apparent to those skilled in the art. Such changes and modifications can be made without departing from the spirit and scope of the disclosure and without diminishing its intended advantages. It is therefore intended that such changes and modifications be covered by the appended claims.

We claim:

1. A sealing structure for sealing the bottom of a beam space between precast panels, comprising:

a first precast panel and a second precast panel formed with a first group of thru apertures and a second group of thru apertures, respectively, and substantially aligned to each other along a single plane and spaced from each other by a space, each of the first precast panel and the second precast panel defining an inner edge adjacent to the space;

a soft pad abutting the space for sealing a bottom of the space, said soft pad extending from the inner edge of the first precast panel to the inner edge of the second precast panel;

a plate abutting the soft pad and extending from the inner edge of the first precast panel to the inner edge of the second precast panel;

a fastening device securing a first side of the plate and an opposite second side of the plate to the first precast panel and the second precast panel, respectively, so as to assist the soft pad in the sealing of the bottom of the space by clamping the soft pad between the plate and the first and the second precast panels, the fastening device having an end(s) extending through at least a number of thru apertures of the first group of thru apertures and the second group of thru apertures and secured to a first surface of the first precast panel and a second surface of the second precast panel, which are opposite to the soft pad, wherein the fastening device does not contact the soft pad.

2. The sealing structure of claim 1, wherein the fastening device comprises:

a first group of bolt locking devices which secure the first side of the plate to the first precast panel by extending through the first side of the plate and through at least a number of thru apertures of the first group of thru apertures;

a second group of bolt locking devices which secure the second side of the plate to the second precast panel by extending through the second side of the plate and through at least a number of thru apertures of the second group of thru apertures.

3. The sealing structure of claim 2, further comprising a first group of ribs abutting against the plate and extending from a first side of the plate toward the second side of the plate, said first group of ribs being fastened with the first precast panel and the second precast panel together by the first group of bolt locking devices and the second group of bolt locking devices.

4. The sealing structure of claim 2, further comprising a second group of ribs abutting against the first surface of the first precast panel and the second surface of the second precast panel, said first surface and said second surface being opposite to the surfaces contacting the soft pad, said second group of ribs being fastened with the first precast panel and the second precast panel together by the first group of bolt locking devices and the second group of bolt locking devices.

5. The sealing structure of claim 4, wherein the second group of ribs comprise one rib which is entirely secured to the first precast panel and one rib which is entirely secured to the second precast panel.

6. The sealing structure of claim 4, wherein at least one rib of the second group of ribs has two ends which are respectively secured to the first precast panel and the second precast panel.

7. The sealing structure of claim 1, wherein at least a number of thru apertures of the first group of thru apertures and the second group of thru apertures are covered with lids.

8. The sealing structure of claim 4, further comprising:

a second group of ribs abutting against the first surface of the first precast panel and the second surface of the second precast panel, which are opposite to the soft pad, said second group of ribs being fastened with the first precast panel and the second precast panel together by the fastening device, wherein the second group of ribs comprise one rib which is entirely secured to the first precast panel and one rib which is entirely secured to the second precast panel.

9. The sealing structure of claim 8, wherein the fastening device comprises:

a first group of bolt locking devices which secure the first side of the plate to the first precast panel by extending through the first side of the plate and through at least a number of thru apertures of the first group of thru apertures;

a second group of bolt locking devices which secure the second side of the plate to the second precast panel by extending through the second side of the plate and through at least a number of thru apertures of the second group of thru apertures.

10. The sealing structure of claim 3, further comprising a second group of ribs abutting against the first surface of the first precast panel and the second surface of the second precast panel, said first surface and said second surface being opposite to the surfaces contacting the soft pad, said second group of ribs being fastened with the first precast panel and the second precast panel together by the first group of bolt locking devices and the second group of bolt locking devices.

11. The sealing structure of claim 2, wherein at least a number of thru apertures of the first group of thru apertures and the second group of thru apertures are covered with lids.

12. The sealing structure of claim 3, wherein at least a number of thru apertures of the first group of thru apertures and the second group of thru apertures are covered with lids.

* * * * *